US008508128B2

(12) United States Patent
Tidhar

(10) Patent No.: US 8,508,128 B2
(45) Date of Patent: Aug. 13, 2013

(54) SYSTEM FOR PROVIDING THERMAL ENERGY RADIATION DETECTABLE BY A THERMAL IMAGING UNIT

(75) Inventor: Gil Tidhar, Modiin (IL)

(73) Assignees: Elta Systems Ltd., Ashdod (IL); Optigo Systems Ltd., Lod (IL)

( * ) Notice: Subject to any disclaimer, the term of this patent is extended or adjusted under 35 U.S.C. 154(b) by 30 days.

(21) Appl. No.: 12/740,788

(22) PCT Filed: Nov. 2, 2008

(86) PCT No.: PCT/IL2008/001438
§ 371 (c)(1),
(2), (4) Date: Oct. 12, 2010

(87) PCT Pub. No.: WO2009/057122
PCT Pub. Date: May 7, 2009

(65) Prior Publication Data

US 2011/0031868 A1 Feb. 10, 2011

(30) Foreign Application Priority Data

Nov. 1, 2007 (IL) ..... 187107
Jun. 16, 2008 (IL) ..... 192228

(51) Int. Cl.
*H01K 1/28* (2006.01)

(52) U.S. Cl.
USPC ..... 313/579; 313/587; 313/315

(58) Field of Classification Search
USPC ..... 313/578, 579, 315
See application file for complete search history.

(56) References Cited

U.S. PATENT DOCUMENTS 4,554,544 A 11/1985 Task
4,588,923 A 5/1986 Hoegler et al.
4,604,680 A 8/1986 Levin et al.
4,774,396 A 9/1988 Salit et al.

(Continued)

FOREIGN PATENT DOCUMENTS

EP 0 043 682 A2 1/1982
GB 740061 11/1955

(Continued)

OTHER PUBLICATIONS

"Halogen," retrieved from *Wikipedia* at http://en.wikipedia.org/wiki/Halogen on Nov. 22, 2010.

(Continued)

*Primary Examiner* — Karabi Guharay
(74) *Attorney, Agent, or Firm* — Oliff & Berridge, PLC

(57) ABSTRACT

In accordance with an aspect of the invention, there is provided a thermal radiation marker (10) adapted to emit radiation within the thermal portion of the infrared spectrum. According to some embodiments of the invention, the thermal radiation marker may include an incandescent filament (16) and a glass or quartz enclosure (12). The incandescent filament may be adapted to produce radiation at least within the thermal portion of the infrared spectrum. The glass or quartz enclosure may include at least a portion that is substantially thin, and may enclose pressurized inert (14) gas and the incandescent filament surrounded by the inert gas. At least a portion of the glass or quartz enclosure may be sufficiently thin so as to enable good transmittance therethrough for tli3rmal radiation approximately in the 3-5&mgr,-m wavelength band. The pressurized inert gas enclosed within the glass or quartz enclosure and surrounding the incandescent filament may enable a regenerative cycle to take place within the enclosure.

20 Claims, 6 Drawing Sheets

(56) References Cited

U.S. PATENT DOCUMENTS

| | | | | |
|---|---|---|---|---|
| 4,912,334 | A | 3/1990 | Anderson | |
| 5,152,870 | A | 10/1992 | Levinson | |
| 5,191,263 | A * | 3/1993 | Konopka | 315/209 R |
| 5,220,173 | A | 6/1993 | Kanstad | |
| 5,438,233 | A | 8/1995 | Boland et al. | |
| 5,939,726 | A | 8/1999 | Wood | |
| 6,087,775 | A | 7/2000 | Levinson et al. | |
| 6,215,416 | B1 | 4/2001 | Henderson | |
| 6,249,005 | B1 | 6/2001 | Johnson | |
| 6,293,678 | B1 | 9/2001 | Schieferstein | |
| 6,567,248 | B1 | 5/2003 | Schmidt et al. | |
| 6,777,701 | B1 | 8/2004 | Inbar | |
| 6,984,061 | B1 | 1/2006 | Soderberg et al. | |
| 7,023,361 | B1 | 4/2006 | Wallace et al. | |
| 7,119,337 | B1 | 10/2006 | Johnson et al. | |
| 7,122,815 | B2 | 10/2006 | Wood | |
| 7,227,162 | B2 | 6/2007 | Barrett et al. | |
| 7,475,852 | B2 | 1/2009 | Hewitt et al. | |
| 7,666,682 | B2 | 2/2010 | Armentrout et al. | |
| 2004/0208602 | A1 * | 10/2004 | Plante | 398/140 |
| 2006/0125658 | A1 | 6/2006 | Dohler et al. | |

FOREIGN PATENT DOCUMENTS

| | | | |
|---|---|---|---|
| GB | 1 455 358 | | 11/1976 |
| WO | WO 2004/000183 | A1 | 12/2003 |
| WO | WO 2004/018376 | A1 | 3/2004 |

OTHER PUBLICATIONS

Buijs, H., "Incandescent Sources for Mid- and Far-infrared Spectrometry," *Handbook of Vibrational Spectroscopy*, 2002, pp. 1-4.

Murph, D., "Ultra-powerful Laser Could Make Incandescent Light Bulbs More Efficient," retrieved from http://www.engadget.com/2009/05/31/ultra-powerful-laser-could-make-incandescent-liglit-bulbs-more-ef/, on Nov. 22, 2010.

Sherwood, J., "Laser Doubles Efficiency of Traditional Lightbulbs," retrieved from http://www/Rochester.edu/news/show.php?id=3385 on Nov. 22, 2010.

"Our Light Source Products," Energetiq: Innovators in Light, retrieved from http://www.energetiq.com/html/ldls.html on Nov. 22, 2010.

International Search Report issued in International Application No. PCT/IL2008/001438 on Sep. 11, 2009.

Written Opinion of the International Searching Authority issued in International Application No. PCT/IL2008/001438 on Sep. 11, 2009.

* cited by examiner

SYSTEM FOR PROVIDING THERMAL ENERGY RADIATION DETECTABLE BY A THERMAL IMAGING UNIT

FIELD OF THE INVENTION

The present invention is in the field of position marking for detection by imaging equipment operating within the thermal portion of the infrared spectrum, and specifically within the Midwave-Infrared and/or Longwave-Infrared spectrum band(s).

LIST OF REFERENCES

The following references are considered to be pertinent for the purpose of understanding the background of the present invention:

U.S. Pat. No. 6,777,701 to Inbar, U.S. Pat. No. 5,939,726 to Wood, U.S. Pat. No. 4,912,334 to Anderson, U.S. Pat. No. 4,774,396 to Salit et al, EP Patent No. 1532078 to Detlef et al, U.S. Pat. No. 5,152,870 to Levinson, U.S. Pat. No. 7,227,162 to Barrett et al, U.S. Pat. No. 6,249,005 to Johnson, U.S. Pat. No. 5,220,173 to Kanstad, U.S. Pat. No. 7,119,337 to Johnson et al, U.S. Pat. No. 6,567,248 to Schmidt et al, U.S. Pat. No. 5,438,233 to Boland, et al, U.S. Pat. No. 6,087,775 Levinson, et al, U.S. Pat. No. 7,023,361 to Wallace, et al.

BACKGROUND

There are many known applications for visual marking. Visual marking may be used to mark the position of a site or an area of interest, the position of an individual or a group of individuals or the location of some unit(s) or equipment. For example, in the battlefield, individuals and units sometimes need to mark their position in order to allow other individuals or units to observe and detect their position. In another example, airport operators need to mark the location and outline of runways in order to enable safer landings and takeoffs.

In many cases, it may be advantageous to use covert marking to mark one's position (be it an individual(s), a unit(s) or a site). Covert marking may prevent detection by an unfriendly or unauthorized observer. Effectiveness and covertness of the marking equipment should preferably be maintained day and night. An example of one application of covert marking is disclosed in U.S. Pat. No. 7,023,361 to Wallace, et al. which relates to a covert runway lighting apparatus and method.

It is known to use Near Infrared (NIR) light sources for nighttime self marking. NIR light sources are invisible to the naked eye, but can be detected, during nighttime, by using night vision goggles (NVG), CCD/CMOS/Vidicon imaging detectors and similar equipment. Such NIR light sources may include lamps, LEDs and semiconductor lasers. An example of a NIR beacon is disclosed in U.S. Pat. No. 4,912,334 to Anderson.

Imaging systems employing the thermal portion of the infrared spectrum (e,g, Mid-Wave Infrared (MWIR) and/or Long-Wave Infrared (LWIR)), are in use in military applications as well as in commercial applications. These systems generate a picture of the infrared radiance differences between objects within their field of view. Imaging systems which operate at the thermal portion of the infrared spectrum (MWIR and/or LWIR) are commonly referred to as "Forward Looking Infrared" or "FUR".

A self-marking device which is visible to FUR has been proposed by Thermal Beacon, Tactronics, Ion-Optics, CI- Systems and other companies. These are based on blackbody radiance of source-objects in the 3-5 μm or the 8-14 μm wavelength bands, where blackbody emission is significant and the atmosphere is transparent.

The source of thermal radiance (the term "thermal radiance" will refer to radiation in the 3-5 μm and/or the 8-14 μm wavelength bands) is usually heaters which achieve a temperature of a few hundreds of Celsius degrees. This is because the blackbody radiation peaks within 3-5 μm in these wavelengths (and thus the energy conversion to the required wavelength band is high), and because there are materials that can be heated to this temperature without melting, oxidizing or disintegrating even in the presence of air. These heaters may be thin carbon films, cavity black-body or other kinds of resistors. These beacons typically emit into a wide solid angle, because of the size of the "black-body" object. In some cases, they include a window which blocks the visible and sometimes NIR energy, so that the beacon is covert to NVG, CCD/CMOS/Vidicon based cameras, and the naked eye.

U.S. Pat. No. 6,777,701 to Inbar discloses a system which utilizes high temperature low mass filament as the emitter, mainly due to the fast response to pulses. Similar emitters are also described in U.S. Pat. No. 5,939,726 to Wood. The temperatures achieved by commercially available filament emitters, such as those available from Cal-Sensors, Assignees of U.S. Pat. No. 5,939,726 is 1000K for the Pulsable Emitters, and 1170K for the steady-state emitters. The filament emitters available from for Ion Optics and SciTek and others achieve similar results.

U.S. Pat. No. 5,438,233 to Boland, et al. discloses a lamp configuration particularly for infrared radiation and that provides an internal arrangement and environment adapted to overcome failure modes of previous broadband infrared sources. The disclosed lamp configuration may incorporate optical elements including spectral filters and lenses enabling wavelength selection, beam shaping, external focusing, collimating, and wave front shaping. It also facilitates optical coupling to external devices including a rotating mirror, shutter and modulator devices. Boland et al. propose to use an inert gas mixture environment within the lamp to prevent oxidization, and therefore allows the filament to reach higher temperatures without failure due to chemical reactions with the surrounding gas.

U.S. Pat. No. 6,087,775 to Levinson, et al. discloses a lamp assembly which comprises an incandescent lamp, and in particular a Halogen lamp, capable of generating light. The incandescent lamp comprises an incandescent lamp tube and at least one filament. The assembly also comprises a shroud separate from the incandescent lamp and mounted in communication with the lamp tube on an exterior of the incandescent lamp tube. The shroud also comprises a coating disposed on the reflecting section of the shroud for reflecting energy having predetermined wavelengths emitted by the incandescent lamp, an in particular for reflecting energy whose wavelength is within the infrared band.

U.S. Pat. No. 6,567,248 to Schmidt, et al. is an example of a Tri-Spectrum Landing Light, which in addition to being capable to provide FLIR emission, is capable of providing visible and infrared light. Schmidt, et al. proposes to use three different modalities to enable the tri-spectrum emission capability.

SUMMARY OF THE INVENTION

In accordance with an aspect of the invention, there is provided a thermal radiation marker adapted to emit radiation within the thermal portion of the infrared spectrum. According to some embodiments of the invention, the thermal radiation marker may include:

an incandescent filament for producing radiation at least within the thermal portion of the infrared spectrum;

a glass or quartz enclosure having at least a portion thereof that is substantially thin, the glass or quartz encloses pressurized inert gas and the incandescent filament surrounded by the inert gas, at least a portion of the glass or quartz enclosure may be sufficiently thin so as to enable good transmittance therethrough for thermal radiation approximately in the 3-5 μm wavelength band, and the pressurized inert gas enclosed within the glass or quartz enclosure and surrounding the incandescent filament may enable a regenerative cycle to take place within the enclosure.

In accordance with further embodiments of the invention at least a portion of the glass or quartz enclosure is sufficiently thin so as to enable good transmittance therethrough for thermal radiation approximately within the 3.4-4.8 μm atmospheric window.

In accordance with still further embodiments of the invention, at least a portion the glass or quartz enclosure is 1 mm thin or thinner. In accordance with still further embodiments of the invention at least a portion of the glass or quartz enclosure is 0.5 mm thin or thinner.

In accordance with some embodiments of the invention the incandescent filament includes Tungsten and the inert gas includes Halogen, and the regenerative cycle may be a Halogen cycle.

In accordance with some embodiments of the invention the thermal radiation marker may include a controller, which is adapted to control said filament in a manner to cause the filament to reach temperatures higher than a free-air oxidization temperature of the filament.

In accordance with some embodiments of the invention, the controller may be adapted cause said filament to reach temperatures well beyond 2000° C., and the regenerative cycle may substantially reduce degradation of the filament, thereby extending its service time.

In accordance with an embodiment of the invention, during operation of the incandescent filament, the glass or quartz enclosure provides a significant radiance within the 8-14 μm wavelength band.

In accordance with an embodiment of the invention, the glass or quartz enclosure may include reflective or absorptive particles incorporated thereinto or the glass or quartz enclosure may be coated with reflective or absorptive particles, and the reflective or absorptive incorporated particles or coating may be adapted to reflect or absorb radiation of various wavelengths outside the 3-5 μm wavelength band.

In accordance with an embodiment of the invention, during operation of the incandescent filament, an outer envelope of the glass or quartz enclosure may reache a temperature of at least 200° C.

In accordance with an embodiment of the invention, the thin glass or quartz enclosure may be adapted to prevent a substantial portion of radiation within any one or more of the following bands to pass therethrough:

the UV wavelength range (0.3-0.4 μm), the visible wavelength range (0.4-0.7 μm), the Near Infrared (NIR) wavelength range (0.7-1.0 μm)

the Short Wave Infrared (SWIR) wavelength range (1-3 μm).

In accordance with an embodiment of the invention, the thermal radiation marker may further include a semiconductor electro-optical unit which is adapted to emit radiation at least within the 8-14 μm wavelength band.

In accordance with an embodiment of the invention, the semiconductor electro-optical device is a Quantum Cascade Laser.

In accordance with an embodiment of the invention, the controller may be adapted to modulate the current which drives the incandescent filament in a rate between 0.2 Hz to 5 Hz.

In accordance with an embodiment of the invention the controller may be adapted to modulate the current between a maximum value and a minimum value, and the minimum value may be at least 10% of the maximum value.

In accordance with an embodiment of the invention, at least a portion of the enclosure may be transparent to at least a portion of the visible light spectrum, and the thermal radiation marker may further include a removable cover that is optically aligned with the portion of the enclosure that is transparent to at least a portion of the visible light spectrum, to thereby enable an operator of the marker to selectively expose the portion of the enclosure that is transparent to at least a portion of the visible light spectrum.

According to a further aspect of the invention there is provided a runway illumination apparatus adapted to emit radiation at least within the thermal portion of the infrared spectrum. According to some embodiments of the invention, the runway illumination apparatus may include:

an incandescent filament for producing radiation at least within the thermal portion of the infrared spectrum;

a glass or quartz enclosure having at least a portion thereof that is substantially thin, the glass or quartz encloses pressurized inert gas and the incandescent filament surrounded by the inert gas, at least a portion of the glass or quartz enclosure may be sufficiently thin so as to enable good transmittance therethrough for thermal radiation approximately in the 3-5 μm wavelength band, and the pressurized inert gas enclosed within the glass or quartz enclosure and surrounding the incandescent filament may enable a regenerative cycle to take place within the enclosure.

According to an embodiment of the invention, at least a portion of the glass or quartz enclosure may be sufficiently thin so as to enable good transmittance therethrough for thermal radiation approximately within the 3.4-4.8 μm atmospheric window.

According to an embodiment of the invention, at least a portion the glass or quartz enclosure may be 1 mm thin or thinner. According to a further embodiment of the invention, at least a portion of the glass or quartz enclosure is 0.5 mm thin or thinner.

According to an embodiment of the invention, the incandescent filament may include Tungsten and the inert gas may include Halogen, and wherein the regenerative cycle is a Halogen cycle.

According to an embodiment of the invention, during operation of the incandescent filament, the glass or quartz enclosure may provides a significant radiance within the 8-14 μm wavelength band.

According to an embodiment of the invention, the glass or quartz enclosure may include reflective or absorptive particles incorporated thereinto or the glass or quartz enclosure may be coated with reflective or absorptive particles, and the reflective or absorptive incorporated particles or coating may be adapted to reflect or absorb radiation of various wavelengths outside the 3-5 μm wavelength band.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

Figure 1:
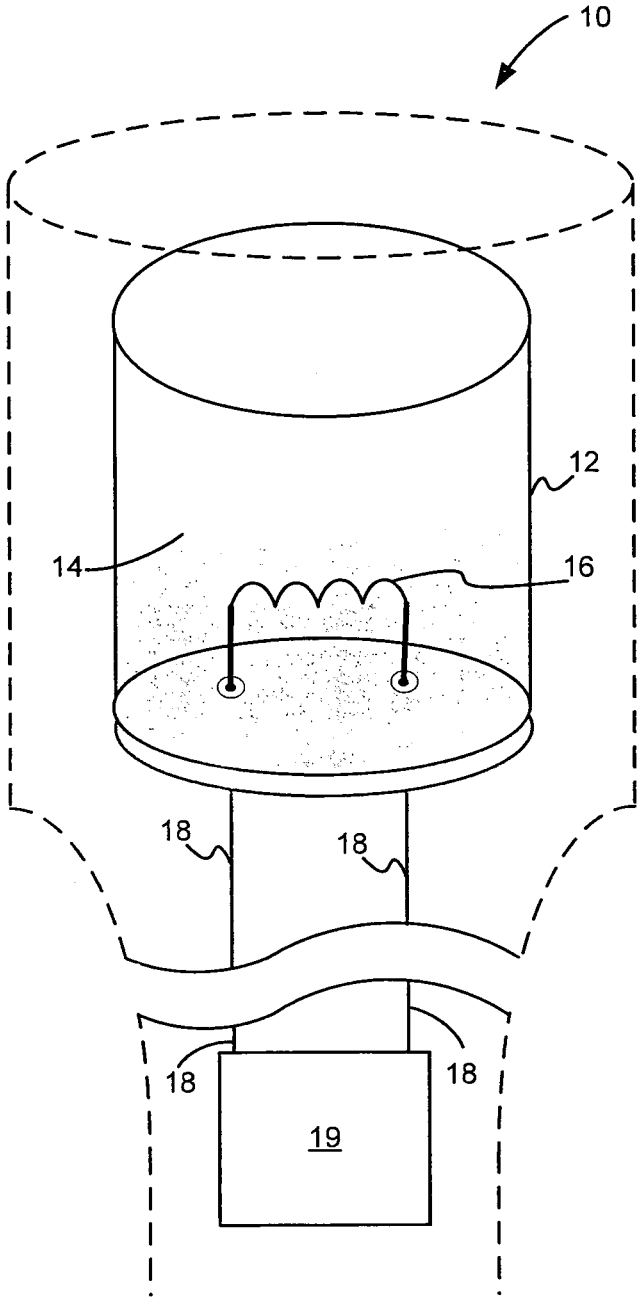
FIG. 1 is a block diagram illustration of a thermal radiation marker according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF THE INVENTION

Some embodiments of the invention relate to a thermal radiation marker. The proposed thermal radiation marker according to some embodiments of the invention may be adapted to emit thermal energy at least within the MWIR band, between 3-5 μm or at least within the 3.4-4.8 μm atmospheric window. Reference is now made to FIG. 1 which is a block diagram illustration of a thermal radiation marker according to some embodiments of the invention. According to some embodiments of the invention, a thermal radiation marker 10 may include a thin glass or quartz enclosure 12 filled with pressurized inert gas 14, and enclosed within the enclosure 12, there is an incandescent filament 16 that is surrounded by the inert gas 14. The incandescent filament 16 may be connected to conductive pins or wires 18 which extend through the enclosure 12 and which are used to conduct electricity and connect the incandescent filament 16 (e.g., a resistive filament) with an energy source (not shown here).

According to some embodiments, the thermal radiation marker 10 may further include a controller 19 and one or more sensors (not shown) which may be used by the controller 19. The controller 19 may be adapted to control various aspects of the operation of the thermal radiation marker 10, including for example, the current that is to be applied to the incandescent filament 16. The controller 19 may control the operation of the thermal radiation marker 10, and in accordance with one example, the current that is applied to the filament 16, based on inputs received from the sensors (not shown). By way of example, the marker 10 may include a thermometer and/or a spectral analyzer.

According to some embodiments of the invention, the controller 19 may be adapted to cause the filament to reach temperatures higher than a free-air oxidization temperature of said filament. As will be described in greater detail below, according to some embodiments of the invention, the incandescent filament 16 is heated to temperatures exceeding 2000° C. and in some embodiments exceeding 3000° C. and therefore produces a substantial amount of thermal energy in the 3-5 μm wavelength band (as well as in other wavelengths). The inventors of the present invention have discovered that it is possible to achieve good transmittance for thermal radiation in the 3-5 μm wavelength band, and more particularly for thermal radiation within the 3.4-4.8 μm atmospheric window, by using a thin glass or quartz enclosure (e.g. a bulb). More particularly, the inventors of the present invention have discovered that a glass or quartz enclosure having a thickness of 1 mm or thinner can provide good transmission for radiation in the 3-5 μm band, and more particularly within the 3.4-4.8 μm atmospheric window. Thus, according to some embodiments of the invention, at least a portion of the thin glass or quartz enclosure 12 is 1 mm thick or thinner and thereby provides good transmission for radiation in the 3-5 μm band, and more particularly for radiation within the 3.4-4.8 μm atmospheric window.

Figure 2:
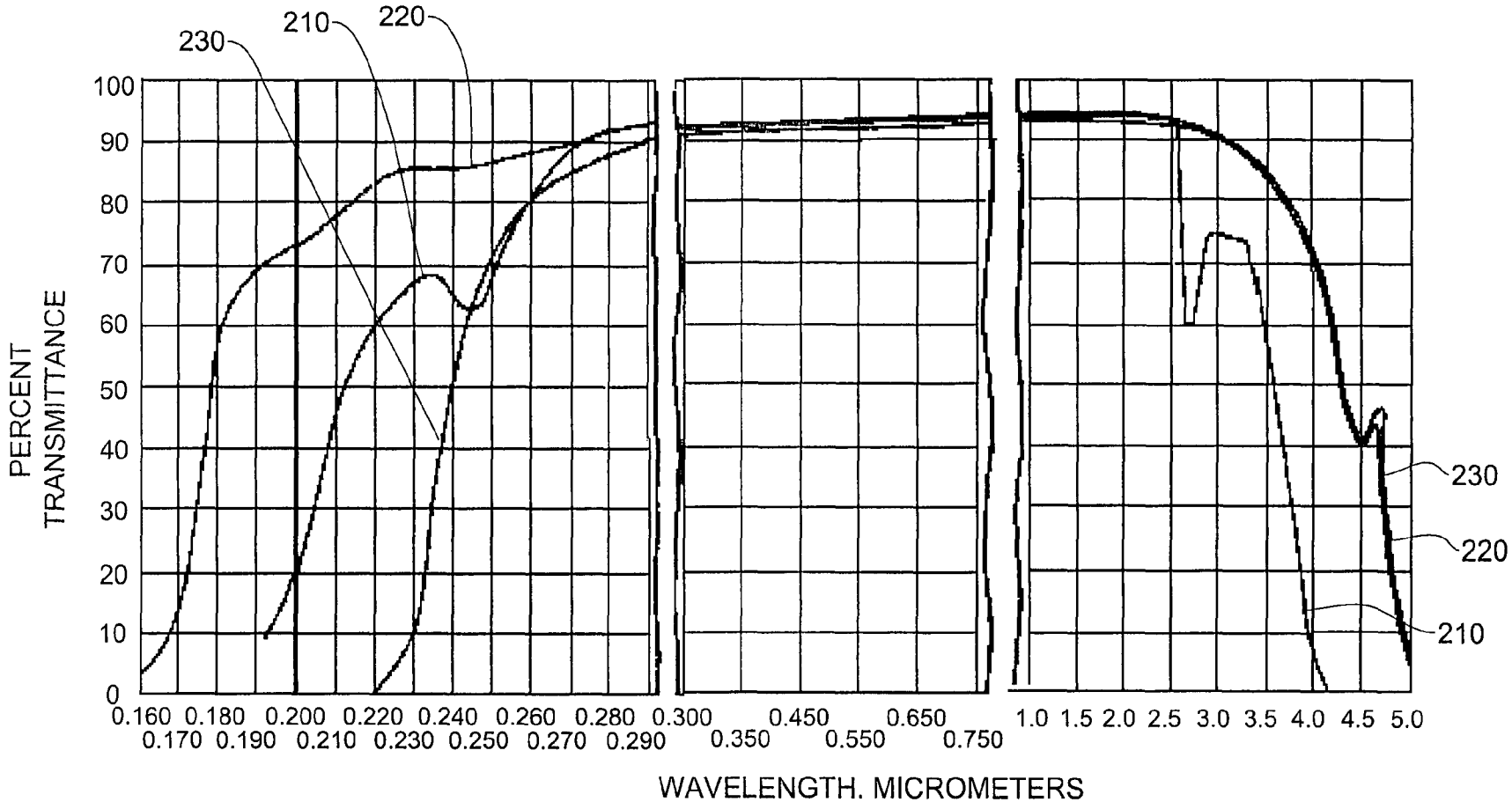
FIG. 2 is a graph that shows the transmittance of a relatively thin fused quartz bulb (1 mm thick) at various wavelengths compared to the transmittance of a substantially thicker fused quartz bulb (10 mm thick)

Reference is now made to FIG. 2 which is a graph that shows the transmittance of a relatively thin fused quartz bulb (1 mm thick) at various wavelengths compared to the transmittance of a substantially thicker fused quartz bulb (10 mm thick). As is shown in FIG. 2 the transmittance of a 10 mm thick fused quartz bulb 210 within the 3-5 μm wavelength band is partial and deteriorates rapidly beyond approximately 3.5 μm. This is problematic especially because the atmospheric window is actually narrower than the 3-5 μm wavelength band and is typically only between 3.4-4.8 μm. On the other hand, the 1 mm thick fused quartz bulb shows 220 and 230 much better transmittance within the 3-5 μm wavelength band. The performance characteristics of the 1 mm thick fused quartz bulb 220 and 230 are even more favorable when transmittance within the 3.4-4.8 μm atmospheric window is considered.

Furthermore, in FIG. 2 and elsewhere throughout the description of the present invention, reference is made to a fused quartz bulb that is 1 mm thick, however, it should be appreciated that further embodiments of the invention contemplate even thinner fused quartz bulbs or an enclosure 12, and that a further improvement in the performance of the fused quartz enclosure within the 3-5 μm wavelength band, and more particularly within the 3.4-4.8 μm atmospheric window, can be achieved by using a fused quartz bulb whose thickness is less than 1 mm. For example, a thermal radiation marker 10 according to one embodiment of the invention includes a thin glass or quartz enclosure 12 that is characterized by having at least a portion thereof that is 0.5 mm thick or thinner.

By providing a glass or quartz enclosure configuration which is characterized by good transmission for thermal radiation in the 3-5 μm (and more particularly within the 3.4-4.8 μm atmospheric window), a thermal radiation marker 10 which utilizes an incandescent filament 16 that is heated to very high temperatures, for example beyond 2000° C., may become operable and practical, as will be explained below.

It would be appreciated that the discovery of particular characteristics at which a glass or quartz bulb provides good transmittance for thermal radiation within the 3-5 μm band may enable to construct a thermal radiation marker 10 that takes advantage of the benefits of a regenerative cycle, while maintaining good transmittance within the 3-5 μm band (and more particularly within the 3.4-4.8 μm atmospheric window). The benefits of a regenerative cycle for various lighting applications are well-known. For example, a thermal radiation marker which utilizes a regenerative cycle may be capable of substantially high operating temperatures, and as a result may provide good performance in terms of optical radiation output (including within the 3-5 μm band).

Figure 3:
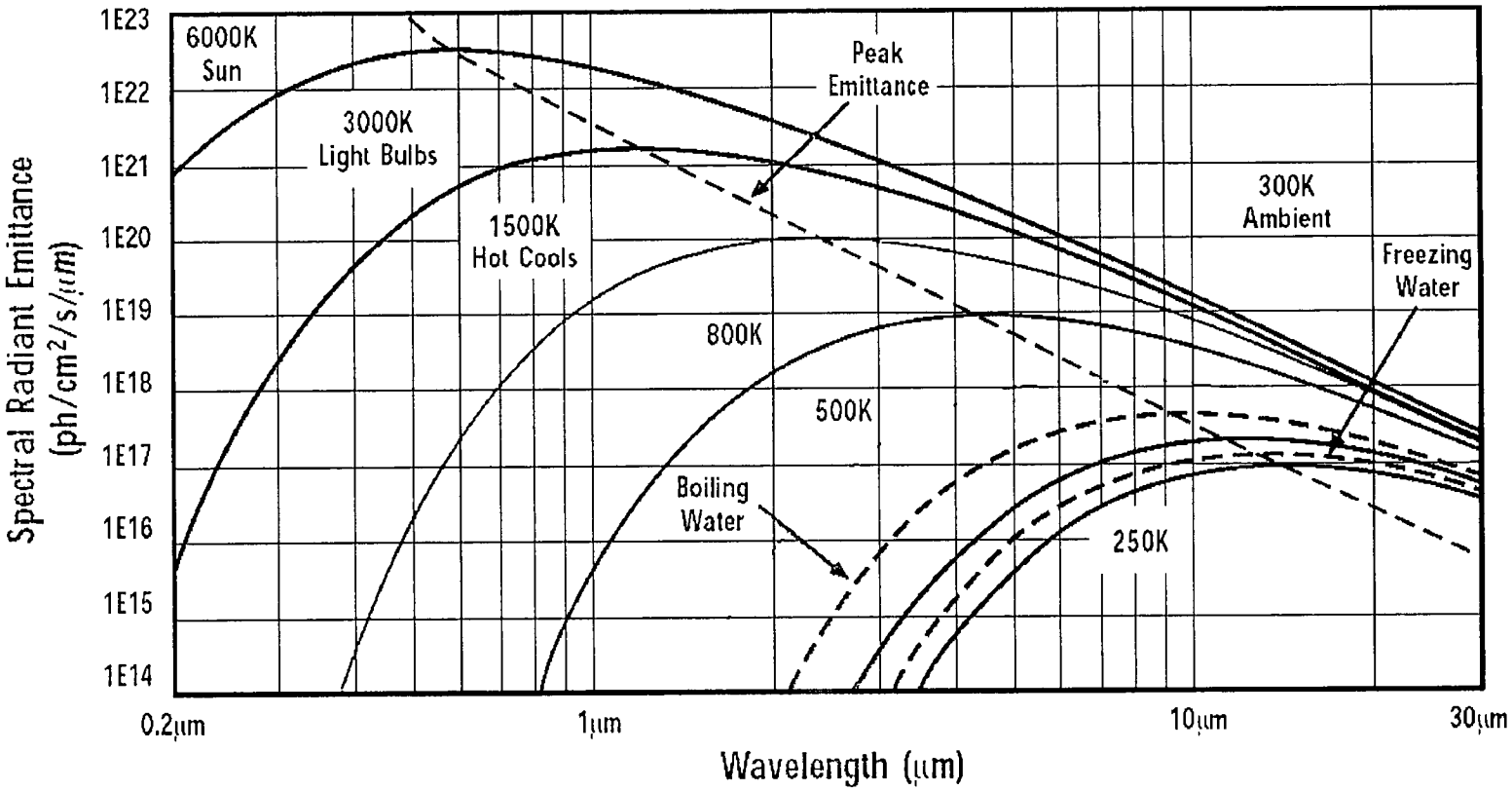
FIG. 3 is a graph showing a blackbody emission spectrum at various temperatures.

Reference is now made to FIG. 3 which is a graph showing a blackbody emission spectrum at various temperatures. As can be seen from the graph of FIG. 3 as temperature (T) increases, the total optical energy radiated over the entire optical spectrum is increased significantly (as $T^4$). Optimizing blackbody temperature for conversion efficiency of electric power to thermal radiation, dictates that the peak wavelength should fall approximately within the desired wavelength band, meaning 800K for the 3-5 μm wavelength band and 474K for the 8-14 μm wavelength band. On the other hand, radiance at all wavelengths increases with the temperature, so the higher the temperature, the higher the radiance. Therefore, when compact size of the emitter is of importance, higher temperature is favorable. It would be appreciated that compact size is a significant design advantage for many applications of a thermal imaging marker, such as the one proposed according to some embodiments of the invention.

It is the regenerative cycle which supports the high operating temperatures (well beyond 2000° C.) by mitigating the degradation of the filament which is otherwise accelerated at such high operating temperatures. The regenerative cycle may also prevent filament residue from building up on the inner bulb-wall in a way that would have caused the bulb to be darkened.

Accordingly, some embodiments of the invention contemplate a thermal radiation marker 10 which includes a combination of a thin glass or quartz enclosure 12 which provides good transmission for thermal radiation at least within the 3-5 μm, pressurized inert gas 14 and an incandescent filament 16 which are both enclosed within the enclosure 12, to thereby give rise, under appropriate operating temperatures, to a regenerative cycle. According to some embodiments, the inert gas 14 comprises Halogen, and the incandescent filament 16 is Tungsten. It would be appreciated, that within a thermal radiation marker which utilizes a Tungsten filament that is enclosed within a thin glass or quartz bulb and the Tungsten filament is surrounded by Halogen, a regeneration cycle known as the "Halogen cycle" or the "Halogen regeneration cycle" may take place.

It would be appreciated that a thermal radiation marker 10 that is comprised of a Tungsten filament enclosed within a thin glass or quartz bulb and surrounded by Halogen, in accordance with some embodiments of the invention, may provide some advantages including the following:

1. Low manufacture cost. The basic design of a thermal radiation marker according to some embodiments of the invention, that is comprised of a Tungsten filament enclosed within a thin glass or quartz bulb and surrounded by Halogen, is similar to commercially available lighting equipment and technologies. Thus, knowledge and equipment that is at least in part available may be used.
2. Fast response time. A thermal radiation marker according to some embodiments of the invention, that is comprised of a Tungsten filament enclosed within a thin glass or quartz enclosure and surrounded by Halogen, may be readily blinked or pulsated, at least as far as the marker's output within the 3-5 μm wavelength band is concerned. For example, the thermal radiation marker may be pulsated by varying the current applied to the Tungsten filament. An incandescent filament as a source of thermal radiation is characterized by relatively low mass and therefore low thermal capacity and is therefore also characterized by relatively rapid heating and cool down. For example, a heating and cool-down cycle at an order of 1 Hz may be achieved. Thus, according to some embodiments of the invention, by varying the current applied to the incandescent filament, the blackbody radiation can be varied as the temperature changes giving rise to pulsating blackbody radiation which varies substantially at the rate of current pulsating. Moreover, when current is modulated between maximum value and minimum value which is tens of per-cent from maximum, then lifetime of the lamp does not diminish, while radiation modulation is strongly observable.
3. Strong output from a small incandescent filament area. The high temperature at which the incandescent filament is operated (in access of 2000° C.), may enable to generate high levels of thermal infrared radiation from a small incandescent filament area. This favorable area to thermal radiation output ratio can be translated into a high radiant intensity beam of thermal radiance.
4. Extended service time. As mentioned above, the thermal radiation marker according to some embodiments of the invention is characterized by being compatible with and enabling a regenerative cycle to take place within the bulb. The regenerative cycle may contribute towards a significantly reduced oxidization and surface deterioration of the incandescent filament and thus improved service time. Also, the Halogen lamp technology is advanced and therefore lifetime is a proven quality of Halogen lamp products.

The thermal radiation marker described above with reference to some embodiments of the invention provides thermal radiation within the MWIR range (within the 3-5 μm band or at least within the 3.4-4.8 μm atmospheric window). The thermal radiation marker provides a relatively strong MWIR radiance output by using a relatively small incandescent filament that is heated to relatively high temperatures, where radiance is strong at all wavelengths, and by providing an enclosure that while being compatible with a regenerative cycle is also substantially transparent to radiation within the MWIR range. As will be described below in further detail, and according to further aspects of the invention, the thermal radiation marker may also be a source of thermal radiation within the LWIR range (typically the 8-14 μm wavelength band), although the thin quartz or glass bulb is typically not transparent to infrared radiation within the 8-14 μm wavelength band.

Figure 4:
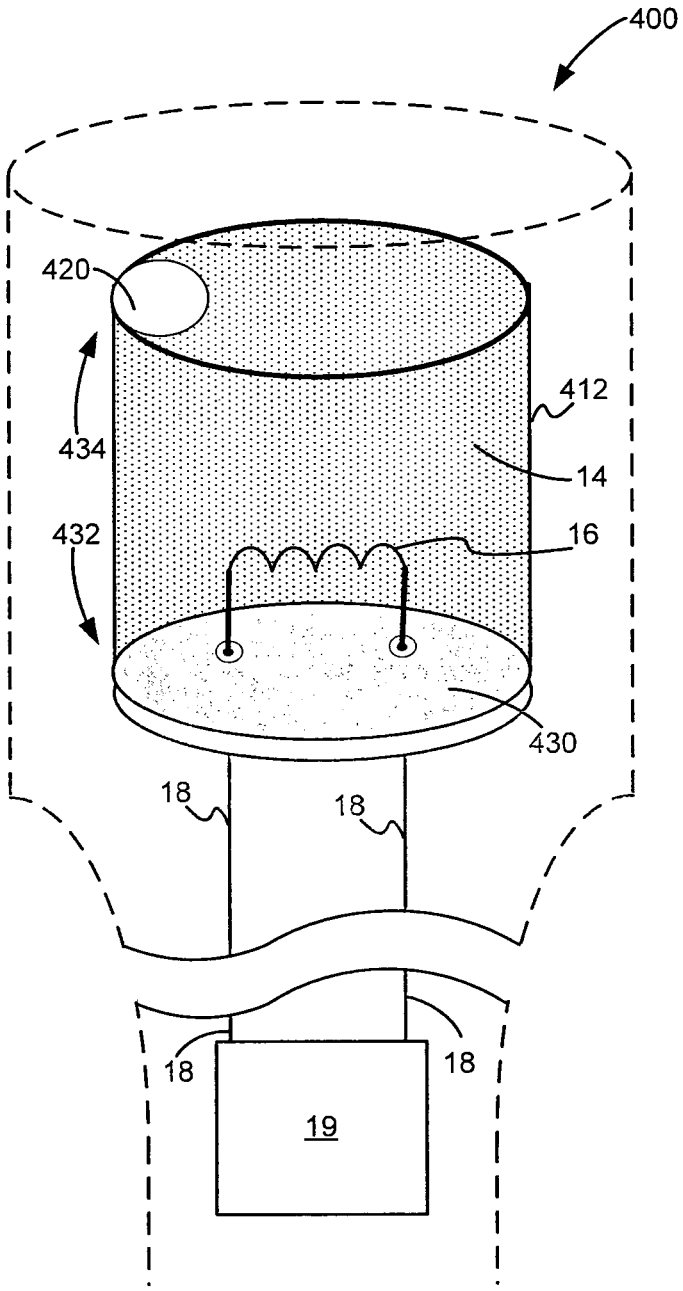
FIG. 4 is a block diagram illustration of a thermal radiation marker that is characterized by having a specific output profile(s), according to some embodiments of the invention.

Reference is now made to FIG. 4 which is a block diagram illustration of a thermal radiation marker that is characterized by having a specific output profile(s), according to some embodiments of the invention. According to some embodiments of the invention, and as is shown in FIG. 4, a thermal radiation marker 400 may include a thin glass or quartz enclosure 412 that is adapted so that it allows only radiation within a certain wavelength band(s) to pass therethrough, and is adapted to prevent radiation of other wavelengths to pass through the thin glass or quartz enclosure 412. The thermal radiation marker 400 may further include an incandescent filament 16 that is surrounded by the inert gas 14 and both are enclosed within the thin glass or quartz enclosure 412 and conductive wires 18 which are adapted to conduct electricity to the incandescent filament 16.

It would be appreciated that a glass or quartz enclosure 412 can be adapted to allow radiation within a certain wavelength band(s) to pass therethrough when the enclosure 412 is made substantially transparent to radiation of this particular wavelength range. It would be further appreciated the that glass or quartz enclosure 412 can be adapted to prevent radiation of other wavelengths from passing through the glass or quartz enclosure 412 when the enclosure 412 is adapted to reflect or absorb substantially all radiation whose wavelength is outside the wavelength band(s) which the thermal radiation marker is intended to radiate.

According to some embodiments of the invention, the thin glass or quartz enclosure 412 may be adapted so that it allows only radiation within a 3-5 μm wavelength band to pass therethrough. According to further embodiments of the invention, the thin glass or quartz enclosure 412 may be adapted so that it allows only radiation within the 3.4-4.8 μm atmospheric window to pass therethrough. As was discussed above in greater detail, a thin glass or quartz enclosure having a thickness that is less that 1 mm in some embodiments, or less than 0.5 mm in other embodiments, may be substantially transparent to radiation within the 3-5 μm wavelength band or at least to radiation within the 3.4-4.8 μm atmospheric window, and would thus be adapted to enable radiation within this wavelength band to pass therethrough.

According to further embodiments of the invention, the thin glass or quartz enclosure 412 may be adapted so that it prevents radiation within any one or more of the following bands to pass therethrough: the UV wavelength range (0.3-0.4 μm), the visible wavelength range (0.4-0.7 μm), the Near Infrared (NIR) wavelength range (0.7-1.0 μm) and in some embodiments the Short Wave Infrared (SWIR) wavelength range (1-3 μm). According to some embodiments of the invention, the thin glass or quartz enclosure 412 may be adapted to absorb and/or to reflect radiation within one or more of these wavelength bands so that it further increases the temperature of enclosure 412 and thus the bulb emits an increased level of blackbody radiation in the Long wave Infrared (LWIR) wavelength range (8-14 μm), as will be further described below.

According to some embodiments of the invention, certain reflective or absorptive particles may incorporated into the thin glass or quartz enclosure 412 or may be used to coat the thin glass or quartz enclosure 412 to thereby adapt it to become reflective or absorptive for radiation of various wavelengths. According to some embodiments the absorbers or reflectors do not affect the transparency of the enclosure within the 3-5 μm band. For example, reflective or absorptive particles may incorporated into the thin glass or quartz enclosure 412 to thereby render it reflective or absorptive for visible light, NIR radiation, SWIR radiation and/or UV radiation. It is preferable that the absorbers/reflectors do not affect the transparency in the 3-5 μm band. Examples of possible absorbers/reflectors include the following:

1. Glass pigments, such as manganese, cobalt, iron and any mix thereof.
2. A coating which may be applied to the glass or quartz enclosure using glass inks, such as ceramic inks, for example.
3. A thin metal coating.
4. A thin/partial metal oxides coating.

In one embodiment, the thermal radiation marker 400 may include a small area 420 or aperture which is not covered or otherwise adapted to absorb or reflect at least a portion of the visible light spectrum or radiation within other wavelength(s). This area or aperture 420 may allow some light emitted from the lamp (typically a very small amount) to be viewed by the user or some sensor, for example, in order to provide an indication as to whether the lamp is actually emitting radiation. According to a further embodiment of the invention, the window 420 may be non-transparent to the Near Infrared wavelength range (0.7-1.0 μm), in order not to render the marker 400 visible to NVGs, CCD/CMOS cameras and/or Vidicons.

In accordance with a further embodiment, the thermal radiation marker 400 may include a removable cover (not shown) that is optically aligned with a portion of the enclosure that is transparent to at least a portion of the visible light spectrum. The removable cover can be used to block visible light unless removed by the user of the marker, to thereby maintain the covertness of the thermal radiation marker 400, while providing a user with the possibility of exposing the portion of the enclosure 412 which transmits at least a portion of the visible light spectrum and thereby enabling monitoring the operation of the marker 400. The aperture may also include a window (not shown) such as a glass window, to prevent remittance of harmful UV light, and/or to reduce the visible light radiation, and/or to add color to the visible light (filter out some of the visible light).

According to some aspects of the invention, the thermal radiation marker may be adapted to provide a significant thermal radiation output in the LWIR band, between 8-14 μm, in addition to the output within the MWIR band (between 3-5 μm or within the 3.4-4.8 μm atmospheric window). As was also mentioned above, the quartz or glass enclosure is typically not transparent to radiation within the 8-14 μm wavelength band, and most of the radiation within the 8-14 μm wavelength band is either blocked or reflected by the enclosure. Nevertheless, according to some embodiments of the invention, relatively high intensity levels of radiation within the 8-14 μm wavelength band may be otherwise achieved, and the thermal radiation marker may thus provide significant radiance within the LWIR band as well as within the MWIR band. There is now provided a description of an incandescence lamp for a thermal radiation marker, according to some embodiments of the invention, which absorbs radiation within the 8-14 μm wavelength band, but at the same time provides a significant thermal radiation output in the 8-14 μm wavelength band in addition to the significant output within the 3-5 μm wavelength band (or within the 3.4-4.8 μm atmospheric window).

The inventors of the present invention have discovered that when an incandescent filament 16 is heated to relatively high temperatures, for example to temperatures in excess of 2000° C., as may be the case with the thermal radiation marker 400, the thin glass or quartz enclosure 412 itself can be used as a blackbody emitter even in wavelengths which are absorbed by the enclosure 412, for example, in the LWIR range (the 8-14 μm wavelength band). For example, the glass or quartz enclosure may reach temperatures at the outer side of the enclosure 412 which are as high as 200° C.-300° C. and possibly higher. It would be appreciated that by providing a thin glass or quartz enclosure 412 as is proposed by some embodiments of the invention, the functionality of the enclosure 412 as a source of radiation within the LWIR range can be improved since at a thickness of 1 mm or less according to one embodiment, or at a thickness of 0.5 mm or less according to a further embodiment, the temperature difference between the inner surface of enclosure 412 and the envelope (the outer surface) of the enclosure 412 can be reduced. Since the inner side of the enclosure 412 can reach 600° C., the temperature of the outer side of the enclosure 412 is typically 200-300° C. and possibly higher. As is shown in FIG. 3, for example, the 8-14 μm emission at 200° C.-300° C. is already significant, in particular when taking into account the wider area of the enclosure compared to the filament. Furthermore, since glass is a good thermal resistor, the thermal isolation of the enclosure 412 from the environment may be relatively high. Thus, although according to some embodiments of the invention, the glass or quartz enclosure 412 may absorb most of the radiation within the 8-14 μm wavelength band, and may therefore block radiation within this wavelength band from propagating through the enclosure 412, the enclosure 412 itself may provide a good source of thermal radiation within the 8-14 μm wavelength band.

According to some embodiments of the invention and as was mentioned above, certain reflective or absorptive particles may incorporated into the thin glass or quartz enclosure 412 or may be used to coat the thin glass or quartz enclosure 412 to thereby adapt it to become reflective or absorptive for radiation of various wavelengths. The inventors of the present invention discovered that by using an enclosure 412 that absorbs or reflects UV light, visible light and NIR light unused energy is either absorbed by the enclosure 412 or is reflected back into the filament 16 and further increases the temperature of the filament 16 and of the enclosure 16 itself. Thus, otherwise wasted energy can be used to increase the temperature of the filament and of the enclosure, with the same amount of power.

Thus, according to some embodiments of the invention, there is provided a thermal radiation marker 400 where the source of thermal radiation may be the incandescent filament 16, the glass or quartz enclosure 412, or a combination of the two. The incandescent filament 16 may be adapted to produce radiation at various wavelengths, including for example radiation within each of the following wavelength bands: the UV band, the visible light band, the NIR band, the MWIR and SWIR bands. The enclosure 412 may be substantially transparent to radiation within the 3-5 μm wavelength band, or at least to radiation within the 3.4-4.8 μm atmospheric window, and may be adapted to absorb or reflect radiation whose wavelength is outside the 3-5 μm or the 3.4-4.8 μm band. Accordingly, the thermal radiation marker 400 may provide output radiation within the 3-5 μm wavelength band by enabling a substantial portion of the 3-5 μm or 3.4-4.8 μm radiation that is produced by incandescent filament 16 to propagate through the enclosure 412, and the thermal radiation marker 400 may provide output radiation within the 8-14 μm wavelength band by causing the enclosure 412 to absorb a sufficient amount of energy so that its temperature rises to a level at which it radiates significant 8-14 μm radiation.

According to some embodiments of the invention, the thermal radiation marker 400 may further include reflectors 430 for reflecting at least a portion of the radiation that is emitted by the incandescent filament 16 at certain directions. The reflectors 430 may be used, for example, for concentrating the radiation into a narrower beam. For example, the reflectors 430 may be used to provide a more focused radiation output at least within the 3-5 μm wavelength band by reflecting radiation within the 3-5 μm wavelength band that is emitted from the incandescent filament 16 towards a back end 432 of the enclosure 412 and redirecting the reflected radiation towards a front end 434 of the enclosure. It would be appreciated that by reflecting radiation that is emitted by the incandescent filament 16 and redirecting that radiation, the intensity of the radiation that is emitted from the direction towards which the radiation is reflected can be increased. It would be further appreciated that since, according to some embodiments, the radiation in the 3-5 μm wavelength band is emitted from a relatively small filament 16, it can be focused to a relatively narrow beam, while the 8-14 μm radiation which is generated by the larger enclosure 412, may be focused to a wider beam, and therefore lower radiation intensity.

The inventors have found that it is preferable to use a convex reflector, preferably two dimensional convex reflector (typically parabolic or similarly shaped convex reflector), that collects the thermal radiation and collimates it into a low-diverging beam. Due to the small area of the suggested incandescent filament, thermal radiation beam divergence can be small with a relatively small reflector. In a preferred embodiment, a Tungsten filament with effective area of 2.4 $mm^2$ and emmissivity of approximately 0.9 is heated to about 3100° C. The thermal energy is reflected using a parabolic reflector with a diameter of 70 mm (90 mm).

As was mentioned above, one of the possible advantages of a thermal radiation marker according to some embodiments of the invention is fast response time. More particularly, a thermal radiation marker which is comprised of a Tungsten filament enclosed within a thin glass or quartz enclosure and surrounded by Halogen may be readily blinked or pulsated, at least as far as the marker's output within the 3-5 μm wavelength band is concerned. For example, the thermal radiation marker may be pulsated by varying the current applied to the Tungsten filament. In another embodiment of this invention, the driving current to the filament is modulated between maximum value and a minimum value, typically half maximum, which enables direct modulation of the thermal radiance with minimal deterioration of the service time of the emitter.

According to some embodiments of the invention, the energy source of the Thermal radiation marker is a portable electrical energy unit. The term "a portable energy unit" as used herein may relate to any power or energy supply unit(s) which while being used as a "stand alone" unit is able to provide power that is for activating components of a system which are operatively connected thereto. Such an energy supply unit may include for example a rechargeable battery or a disposable (non-rechargeable) battery, as well as other energy storage and discharge units, both such that they are connectable to some power grid or to some other non-portable energy sources.

In some embodiment invention, the weight of the thermal radiation marker may be less than 2000 grams (excluding the portable energy unit), and in one embodiment the weight of the thermal radiation marker may be less than 900 grams. It would be appreciated that the Halogen lamp-like configuration of the proposed thermal radiation marker may contribute significantly to the relatively low weight of the proposed design. Such a thermal marker, with power consumption of 20 Watts could be clearly identified by FLIRs working in LWIR range from approximately 3 kilometers, and by FLIRs working in MWIR range from over 10 kilometers. The beam divergence in MWIR is approximately 10 degrees, and in LWIR 30 degrees.

Figure 5:
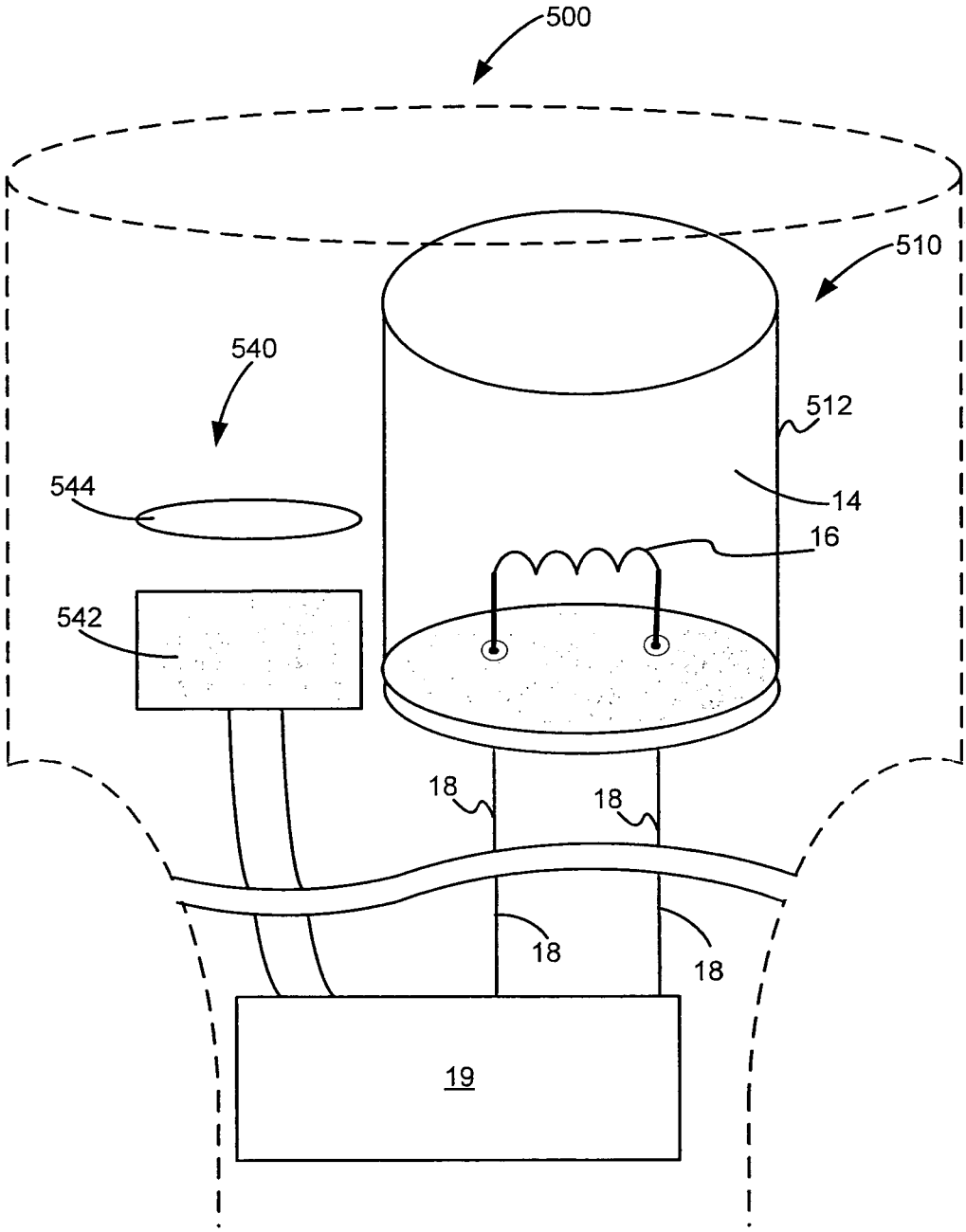
FIG. 5 is a block diagram illustration of a thermal radiation marker which includes a filament based radiation source and a semiconductor laser thermal radiation source, according to some embodiments of the invention.

Reference is now made to FIG. 5, which is a block diagram illustration of a thermal radiation marker which includes a filament based radiation source and a semiconductor laser thermal radiation source, according to some embodiments of the invention. According to some embodiments of the invention, a thermal radiation marker 500 which includes a filament based radiation source 510 and a semiconductor laser thermal radiation source 540 may be provided. The filament based radiation source 510 may be similar to the radiation source depicted and described with reference to FIG. 1, for example, and may include an incandescent filament 16 that is surrounded by the inert gas 14 and both are enclosed within a thin glass or quartz enclosure 512. The semiconductor laser thermal radiation source 540, may include a semiconductor laser unit 542, such as a Quantum Cascade Laser (QCL) and respective optics including, for example, collimating optics 544, such as a lens, or a Compound Parabolic Collector (CPC). According to one embodiment, the thermal radiation marker 500 may be configured so that most or substantially all of the 3-5 μm radiation that is produced by the thermal radiation marker 500 is produced by the filament based radiation source 510, and at least a portion of the 8-14 μm radiation is generated by the semiconductor laser thermal radiation source 540.

It would be appreciated that the configuration depicted by FIG. 5 and described above with reference thereto, may combine the benefits of filament based radiation source 510 which is relatively power efficient within the 3-5 μm band and the benefits of the semiconductor laser thermal radiation source 540, specifically a QCL laser, which is a more efficient thermal infrared radiance source than a lamp, particularly in 8-14 μm band. A thermal radiation marker according to some embodiments of the invention, which combines the benefits of the filament based radiation source 510 with the benefits of the semiconductor laser thermal radiation source 540 can provide a balance of cost and power efficiency and may thus be a practical solution for marking within both the 3-5 μm and the 8-14 μm wavelength bands.

Figure 6:
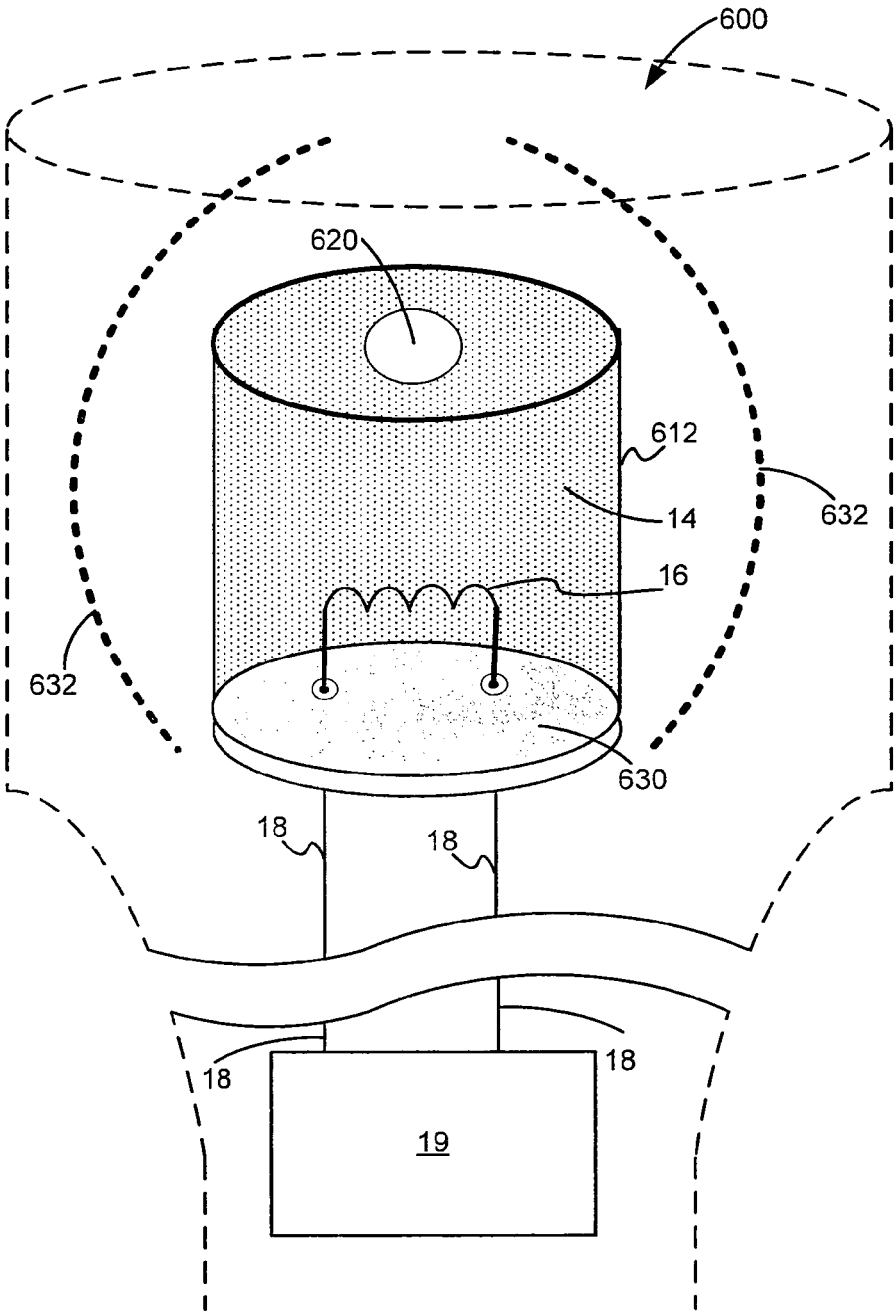
FIG. 6 is a block diagram illustration of a runway illumination apparatus, according to some embodiments of the invention.

According to a further aspect of the invention, there is provided a runway illumination apparatus. Reference is now made to FIG. 6 which is a block diagram illustration of a runway illumination apparatus, according to some embodiments of the invention. According to some embodiments of the invention, the proposed runway illumination apparatus 600 may be used as or as part of a runway lighting fixture of the type that is typically installed at an aircraft installation, such as an airport, to provide signals to aircrafts. It would be appreciated that various details of the description provided above which were made with reference to some of the embodiments of the thermal radiation marker are also pertinent to some of the embodiments of the runway illumination apparatus. For convenience, there is now provided a short description of some features which were described above with reference to some embodiments of a thermal radiation marker and which may also be pertinent to some embodiments of the runway illumination apparatus. It should also be appreciated that some details of the description provided below with reference to some of the embodiments of the runway illumination apparatus are also applicable to some embodiments of the thermal radiation marker. Accordingly, unless specifically stated or if it is otherwise apparent from the description, the terms "thermal radiation marker" and "runway illumination apparatus" are to be construed as being interchangeable and any reference made to either term is may also be applicable to the other term.

According to some embodiments of the invention, the runway illumination apparatus 600 may be adapted to provide a significant thermal radiation output both within the 3-5 μm wavelength band (or at least within the 3.4-4.8 μm atmospheric window) and within the 8-14 μm wavelength band. The incandescent filament 16 may be connected to conductive pins or wires 18 which extend through the enclosure 612 and which are used to conduct electricity and connect the incandescent filament 16 (e.g., a resistive filament) with an energy source (now shown here). According to some embodiments, the runway illumination apparatus 600 may further include a controller 19 and one or more sensors (not shown) which may be used by the controller 19.

As was mentioned above, the combination of an incandescent filament 16 that is surrounded by inert gas 14 and both are enclosed within a thin glass or quartz enclosure 612, enables driving the incandescent filament 16 to operating temperatures which are substantially high. As was illustrated by FIG. 3, the high temperatures achievable by the incandescent filament 16 enable it to provide a relatively high radiance output, at all wavelengths. As was also mentioned above, the degradation of the incandescent filament 16 at such high temperatures is substantially reduced thanks to a regenerative cycle, or in accordance with one embodiment a Halogen cycle, a process which is enabled by the combination of the incandescent filament 16 surrounded by the inert gas 14 and the enclosure of both within the thin glass or quartz enclosure 612 (in the case of the Halogen cycle embodiment, the filament includes Tungsten and the inert gas includes Halogen).

With respect to the runway illumination apparatus's 600 output within the 3-5 μm wavelength band (or at least within the 3.4-4.8 μm atmospheric window), it was mentioned above, that by providing a relatively thin glass or quartz enclosure 612 that is, according to one embodiment 1 mm or thinner, and according to a further embodiment 0.5 mm or thinner, a relatively high transmittance of radiation within the 3-5 μm wavelength band (or at least within the 3.4-4.8 μm atmospheric window) is achieved.

The radiation output within the 8-14 μm wavelength band may be provided by the outer envelope of the glass or quartz enclosure 612. The relatively high operating temperatures of the incandescent filament 16 and the use of a relatively thin glass or quartz enclosure 612 contribute towards relatively high temperatures at the outer envelope of the enclosure 612. Furthermore, the glass or quartz enclosure 612 may be incorporated with certain reflective or absorptive particles or may be coated with some reflective or absorptive layer(s) which are adapted to absorb or reflect radiation within certain wavelengths and contribute to the temperature of the outer envelope of the enclosure 612. Thus, according to some embodiments of the invention, the outer envelope of the glass or quartz enclosure 612 may reach temperatures at which the emission of radiation within the 8-14 μm wavelength band is relatively high. The wider area of the enclosure 612 compared to the filament 16 (which is the source of the radiation within the 3-5 μm wavelength band) also contributes to its noticeability as a source of radiation in the thermal infrared range. For example, temperatures in the order of 200° C.-300° C. and possibly higher may be achieved during operation of the incandescent filament 16. As is shown in FIG. 3, for example, the 8-14 μm emission at 200° C.-300° C. is already significant, in particular when taking into account the wider area of the enclosure compared to the filament. Furthermore, since glass is a good thermal resistor, the thermal isolation of the enclosure 612 from the environment may be relatively high.

The reflective particles or layer(s) may contribute to the temperature of the outer envelope of the glass or quartz enclosure 612 being increased, by reflecting some of the energy emitted by the incandescent filament back into the enclosure 612, further increasing the temperature of the incandescent filament 16 and/or the temperature within the enclosure 612, and subsequently also the temperature at the outer envelope of the enclosure 612. The absorptive particles or layer(s) may be adapted to absorb some of the energy within the enclosure 612 (or a coating coupled to the enclosure), and subsequently contribute towards increased temperature at the outer envelope of the enclosure 612.

According to some embodiments of the invention, the runway illumination apparatus 600 may further include permanent reflectors 630 and possibly also selectively removable reflectors 632. The permanent reflectors 630 may be used for reflecting at least a portion of the radiation that is emitted by the incandescent filament 16 and/or radiation that is emitted by the outer envelope of the enclosure 612 at certain directions. The permanent reflectors 630 may be used, for example, for concentrating the radiation into a narrower beam. For example, the permanent reflectors 630 may be used to provide a more focused radiation output by reflecting radiation that is emitted towards a back end of the enclosure 612 and redirecting the reflected radiation towards a front end of the enclosure 612. It would be appreciated that by reflecting radiation that is emitted and redirecting that radiation, the intensity of the radiation that is emitted from the direction towards which the radiation is reflected can be increased.

According to some embodiments of the invention, the selectively removable reflectors 632 may be used to selectively reflect and possibly to selectively block radiation within certain wavelengths. The selectively removable reflectors 632 may also be adapted to be partially retracted, to thereby provide a selective beam profile for radiation within certain wavelengths. According to some embodiments of the invention, the selectively removable reflectors 632 may be operatively associated with the control unit 19, which may control the operation of the selectively removable reflectors 632.

According to some embodiments of the invention, the selectively removable reflectors 632 may be retractable or otherwise removable either manually or automatically, according to instructions received from a user or in accordance with predefined criteria. According to one embodiment of the invention, the selectively removable reflectors 632 may be used in combination with the reflective particles or coating layers by enabling an operator (human or machine) of the runway illumination apparatus 600 to utilize the apparatus 600 to selectively provide a visible light output of a certain wavelength (or wavelength range). For example, the reflective particles or coating layers may be selected so that in addition to being substantially transparent to radiation within the 3-5 μm wavelength band (or at least within the 3.4-4.8 μm atmospheric window) it is also transparent to visible light within a certain wavelength range (e.g. green light). The selectively removable reflectors 632 may be used to either block the visible light that is able to pass through the enclosure 612 and its absorptive and/or reflective particles, for example during covert operation mode, and may reflect it back towards the outer envelope of the enclosure 612, possibly contributing to its temperature, or when removed, for example, during full visibility mode, the selectively removable reflectors 632 may effectively allow the portion of visible light which can pass through the enclosure 612 and its absorptive and/or reflective particles to radiate out of the runway illumination apparatus 600. The selectively removable reflectors 632 may also provide a further filtering layer in addition to the filtering by the enclosure 612 and its absorptive and/or reflective particles and may prevent (or allow) radiation within certain wavelength range(s) to pass therethrough.

Accordingly to some embodiments of the invention the proposed runway illumination apparatus may be visible to various thermal imaging devices which operate within the MWIR and/or LWIR range of the thermal infrared spectrum. Thus, it would be appreciated that in accordance with some embodiments of the invention, the runway illumination apparatus may be adapted to provide a non-visible light signal to an aircraft that is equipped with the appropriate imaging equipment, and thereby enable covert marking of the runway. However, as was mentioned above, the runway illumination apparatus according to further embodiments of the invention may not necessarily be limited to being operated as a source of convert illumination and may be further adapted to provide visible light output to thereby provide a visible signal for an aircraft. In accordance with further embodiments of the invention, the visible output and/or the thermal output (within the MWIR and/or LWIR range) may be selectable by a user or by a machine.

It would be appreciated that the runway illumination apparatus according to some embodiments of the invention may provide a versatile runway illumination unit and good performance within the MWIR and/or LWIR range and possibly also as a source of visible light. It would also be appreciated that the runway illumination apparatus according to some embodiments of the invention may present good durability, convenient maintainability and relatively low manufacturing and maintenance cost. Furthermore, it would be appreciated that the runway illumination apparatus according to some embodiments of the invention may enable flexible operating profiles including compatibility with a wide variety of imaging devices operating at various thermal infrared spectrum and/or visible spectrum ranges, possibility of providing selective output in terms of the output's spectrum range(s) and can readily blinked or flickered.

While certain features of the invention have been illustrated and described herein, many modifications, substitutions, changes, and equivalents will occur to those skilled in the art. It is therefore to be understood that the appended claims are intended to cover all such modifications and changes as fall within the true scope of the invention.

The invention claimed is:

1. A thermal radiation marker, comprising:

an enclosure, made of glass or quartz;

an incandescent filament for producing radiation at least within the thermal portion of the infrared spectrum;

pressurized inert gas, wherein the pressurized inert gas and the incandescent filament are enclosed in the enclosure, and the incandescent filament is surrounded by the inert gas; and at least a portion of the glass or quartz enclosure having a thickness of 1 mm or less provides good transmittance therethrough for thermal radiation in 3-5 μm wavelength band, and during operation of the thermal radiation marker, the glass or quartz enclosure provides a significant radiance within 8-14 μm wavelength band.

2. The thermal radiation marker according to claim 1, wherein the glass or quartz enclosure is usable, including by virtue of its thickness, providing good transmittance therethrough for thermal radiation within the 3.4-4.8 μm atmospheric window.

3. The thermal radiation marker according to claim 1, wherein the thickness of at least a portion of the glass or quartz enclosure is 0.5 mm or less.

4. The thermal radiation marker according to claim 1, wherein the glass or quartz enclosure has reflective or absorptive particles incorporated thereinto, or the glass or quartz enclosure is coated with reflective or absorptive particles, and the reflective or absorptive particles are provided to increase the reflectance or absorption of the enclosure for radiation outside the 3-5 μm wavelength band, wherein the enclosure is provided to prevent a substantial portion of radiation within any one or more of the following bands to pass therethrough:

the UV wavelength range (0.3-0.4 μm), the visible wavelength range (0.4-0.7 μm), the Near Infrared (NIR) wavelength range (0.7-1.0 μm), the Short Wave Infrared (SWIR) wavelength range (1-3 μm).

5. The thermal radiation marker according to claim 4, where during operation of the incandescent filament, an outer envelope of the enclosure reaches a temperature of at least 200° C.

6. The thermal radiation marker according to claim 1, further comprising a controller that is adapted to modulate a current which drives the incandescent filament at a rate between 0.2 Hz to 5 Hz, thereby pulsating the thermal radiation marker's output at least within the 3-5 μm wavelength band.

7. The thermal radiation marker according to claim 6, wherein said controller is adapted to pulsate the thermal radiation marker's output at least within the 3-5 μm wavelength band by causing the drive current that is applied to said incandescent filament to module between a maximum value and a minimum value.

8. The thermal radiation marker according to claim 7, wherein said minimum value is approximately half of said maximum value.

9. The thermal radiation marker according to claim 6, wherein said incandescent filament is characterized by an effective area of approximately 2.4 $mm^2$ and emissivity of approximately 0.9.

10. The thermal radiation marker according to claim 9, wherein said incandescent filament is heated to approximately 3100° C.

11. The thermal radiation marker according to claim 1, wherein at least a portion of the enclosure is transparent to at least a portion of the visible light spectrum, and wherein said thermal radiation marker further includes a removable cover that is optically aligned with the portion of the enclosure that is transparent to at least a portion of the visible light spectrum, to thereby enable an operator of the marker to selectively expose the portion of the enclosure that is transparent to at least a portion of the visible light spectrum.

12. The thermal radiation marker according to claim 1, wherein the conditions within the enclosure enable a regenerative cycle.

13. The radiation marker according to claim 12, wherein said incandescent filament includes Tungsten and said inert gas includes Halogen, and wherein said regenerative cycle is a Halogen cycle.

14. The thermal radiation marker according to claim 12, further comprising a controller, which is adapted to control said filament in a manner to cause the filament to reach temperatures higher than a free-air oxidization temperature of the filament.

15. The thermal radiation marker according to claim 14, wherein said controller is adapted to cause said filament to reach temperatures well beyond 2000° C., and wherein the regenerative cycle substantially reduces degradation of the filament, thereby extending its service time.

16. The thermal radiation marker according to claim 15, further comprising a semiconductor electro-optical unit which is provided to emit radiation at least within the 8-14 μm wavelength band.

17. The thermal radiation marker according to claim 16, where said semiconductor electro-optical device is a Quantum Cascade Laser.

18. A runway illumination apparatus comprising:

an; enclosure, made of glass or quartz;

an incandescent filament for producing radiation at least within the thermal portion of the infrared spectrum;

pressurized inert gas, wherein the pressurized inert gas and the incandescent filament are enclosed in the enclosure, and the incandescent filament is surrounded by the inert gas; and at least a portion of the glass or quartz enclosure having a thickness of 1 mm or less, providing good transmittance therethrough for thermal radiation in 3-5 μm wavelength band, and during operation of the runway illumination apparatus, the glass or quartz enclosure provides a significant radiance within the 8-14 μm wavelength band.

19. The apparatus according to claim 18, wherein the glass or quartz enclosure is usable, by virtue of its thickness, providing good transmittance therethrough for thermal radiation within 3.4-4.8 μm atmospheric window.

20. The apparatus according to claim 18, wherein the thickness of at least a portion of the glass or quartz emission aperture is 0.5 mm or less.

* * * * *